US009938709B2

(12) United States Patent
Daudet et al.

(10) Patent No.: US 9,938,709 B2
(45) Date of Patent: Apr. 10, 2018

(54) MOMENT RESISTING KNEEWALL CONNECTOR

(71) Applicants: Larry Randall Daudet, Brentwood, CA (US); Jin-jie Lin, Livermore, CA (US); Timothy M. Stauffer, Pleasant Hill, CA (US); Hien Nguyen, San Jose, CA (US)

(72) Inventors: Larry Randall Daudet, Brentwood, CA (US); Jin-jie Lin, Livermore, CA (US); Timothy M. Stauffer, Pleasant Hill, CA (US); Hien Nguyen, San Jose, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 15/247,810

(22) Filed: Aug. 25, 2016

(65) Prior Publication Data

US 2017/0058505 A1 Mar. 2, 2017

(51) Int. Cl.

| | |
|---|---|
| ***E04C 2/38*** | (2006.01) |
| ***E04B 1/24*** | (2006.01) |
| ***E04B 2/76*** | (2006.01) |
| *E04B 1/26* | (2006.01) |

(52) U.S. Cl.

CPC ..... *E04B 1/2403* (2013.01); *E04B 2/767* (2013.01); *E04B 2001/2415* (2013.01); *E04B 2001/2418* (2013.01); *E04B 2001/2463* (2013.01); *E04B 2001/2684* (2013.01)

(58) Field of Classification Search

CPC ..... E04B 1/2403; E04B 2/767; E04B 2001/2415; E04B 2001/2418; E04B 2001/2684; E04B 2001/2463

USPC ..... 52/656.9, 658, 657, 167.4, 293.3, 295

See application file for complete search history.

(56) References Cited

U.S. PATENT DOCUMENTS

| | | | | |
|---|---|---|---|---|
| 1,486,509 | A * | 3/1924 | Whittaker | E06B 1/6015 52/215 |
| 4,744,192 | A * | 5/1988 | Commins | E04B 1/2608 403/232.1 |
| 5,218,803 | A | 6/1993 | Wright | |
| 5,664,392 | A * | 9/1997 | Mucha | E04B 2/96 248/262 |
| 5,794,395 | A * | 8/1998 | Reed | E04F 11/1812 403/230 |

(Continued)

FOREIGN PATENT DOCUMENTS

| | | |
|---|---|---|
| AU | 2010224302 | 3/2011 |

OTHER PUBLICATIONS

European Search Report and Accompanying Correspondence, Application No. EP 16185879, dated Nov. 28, 2016, 8 pages, European Patent Office, Germany.

*Primary Examiner* — Basil S Katcheves

(74) *Attorney, Agent, or Firm* — Charles R. Cypher; James R. Cypher

(57) ABSTRACT

A connection is provided between first and second building structural members, wherein a connector is made up of a stiffener and a connection element, and the stiffener nests within the connection element, and both the stiffener and the connection element are attached to the second building structural member with the same fastener or fasteners, and similarly, both the stiffener and the connection element are attached to the first building structural member with the same fastener or fasteners.

19 Claims, 7 Drawing Sheets

(56) References Cited

U.S. PATENT DOCUMENTS 5,906,080 A * 5/1999 diGirolamo ..... E04B 2/7453 411/546
5,979,130 A * 11/1999 Gregg ..... E04B 1/2604 403/190
6,158,188 A * 12/2000 Shahnazarian ..... E04B 1/2604 403/190
6,213,679 B1 * 4/2001 Frobosilo ..... E04B 2/82 403/14
6,250,041 B1 * 6/2001 Seccombe ..... E04B 1/2604 403/190
6,513,290 B2 2/2003 Leek
6,688,069 B2 * 2/2004 Zadeh ..... E04B 1/2403 52/712
6,719,481 B2 * 4/2004 Hoffmann ..... F16B 7/18 403/13
7,104,024 B1 9/2006 diGirolamo et al.
7,299,593 B1 11/2007 diGirolamo et al.
7,503,150 B1 * 3/2009 diGirolamo ..... E04B 2/96 403/403
7,533,508 B1 5/2009 diGirolamo et al.
8,387,321 B2 3/2013 diGirolamo et al.
8,516,769 B2 8/2013 Hanig et al.
8,555,580 B2 * 10/2013 Vilasineekul ..... E04B 1/2604 52/293.3
8,555,592 B2 * 10/2013 Daudet ..... E04B 1/2403 52/489.1
8,769,887 B2 * 7/2014 Proffitt, Jr. ..... E04B 2/58 52/167.3
9,032,681 B1 * 5/2015 Brady ..... E04B 1/41 52/404.1
9,091,056 B2 * 7/2015 Stauffer ..... E04B 1/40
2002/0062617 A1 * 5/2002 diGirolamo ..... E04B 2/767 52/688
2006/0032180 A1 * 2/2006 Peterson ..... E04B 2/96 52/712
2010/0083606 A1 4/2010 Davis et al.
2010/0126103 A1 * 5/2010 diGirolamo ..... E04B 2/58 52/655.1

* cited by examiner

MOMENT RESISTING KNEEWALL CONNECTOR

BACKGROUND OF THE INVENTION

This invention relates to a connector for anchoring a first building structural member to a second building structural member. The connector works in conjunction with a separate anchor member that is received by or is attached to the second building structural member and with fasteners for attaching the connector to the first building structural member.

The present invention finds particular use in anchoring the vertical stud of a wall to a base supporting the wall, and even more particularly to anchoring a sheet metal stud that is part of wall made from cold formed steel members. State of the art connectors for this application are typically made from sheet metal. See U.S. Pat. No. 5,218,803, granted Jun. 15, 1993, to Jeff A. Wright; U.S. Pat. No. 7,299,593 granted Nov. 27, 2007 to diGirolamo and Torres; U.S. Pat. No. 7,533,508, granted May 19, 2009, to diGirolamo and Torres, and U.S. Pat. No. 8,387,321, granted Mar. 5, 2013 to diGirolamo, Herrman and Abdel-Rahman. These patents teach connectors that are specifically designed to help the studs in steel-framed walls resist tension forces. U.S. Pat. No. 8,516,769 also teaches a similar connector designed to resist uplift forces. While there are many recent patents in this field, the inventors have found that a connector that is capable of being mass produced and installed inexpensively should be made even stronger for this connection.

Typically, these connectors work in conjunction with a separate anchor member and attach to the side face of the first building structural member, generally a vertically disposed stud in a vertical wall. The anchor member attaches at the seat of the connector. This seat is connected to a back member, and the back member attaches to the side face of the stud or post. In some of the prior art connectors, there are one or more side member to increase the strength of the connector or to connect the seat member to the back member.

The holdown connector of the present invention improves upon the prior art by providing a holdown that withstands very high tension loads with minimal deflection, while being economical to produce.

SUMMARY OF THE INVENTION

The present invention is a connection between a first building structural member and a second building structural member using a connector, an anchor member and fasteners.

The anchor member is held by the second building structural member. The anchor member has a first end which protrudes above the second building structural member. A connector receives the first end of the anchor member. The connector consists of a connection element and a stiffener. The connection element has a base and back member. The base of the connection element is formed with an opening for receiving the anchor member there through. The separate stiffener, which overlays the base and is in contact with the back member of the connection element, is formed with an opening for receiving the anchor member. The stiffener is connected to the anchor member. A first building structural member is in contact with the back member. Fasteners complete the connection by connecting the back member of the connection element to the first building structural member. These same fasteners also connect the stiffener to the first building structural member. The stiffener and the connection element of the connector are formed with closely or exactly conforming members and surfaces so that stretch of the connection element is minimized. Furthermore, the junctures between different members of the stiffener and connection element are formed as continuously curved members with large radii so as to reduce failure of the connection element.

The object of the present invention is to provide a connector that better withstands tension forces than the prior art, while still being economical to produce and simple to install.

The object of making a holdown that is economical to produce is achieved by utilizing a design that is easily formed from sheet steel with a minimum of costly secondary operations, such as painting and welding.

These and other objects of the present invention will become apparent, with reference to the drawings, the description of the preferred embodiment and the claims.

DESCRIPTION OF THE PREFERRED EMBODIMENT

Figure 1:
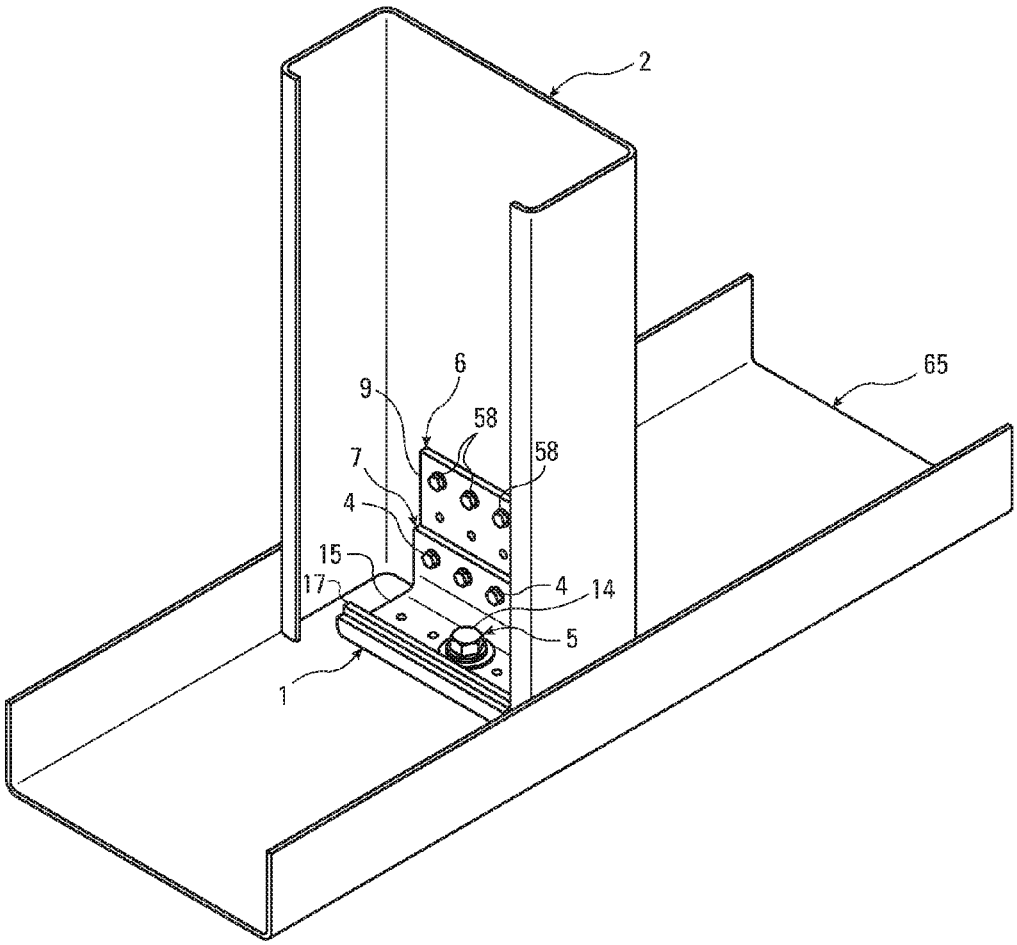
FIG. 1 is a perspective view of a vertical member in a building structure. The vertical member is anchored by the connector of the present invention in conjunction with threaded fasteners and an anchor member.
Figure 2:
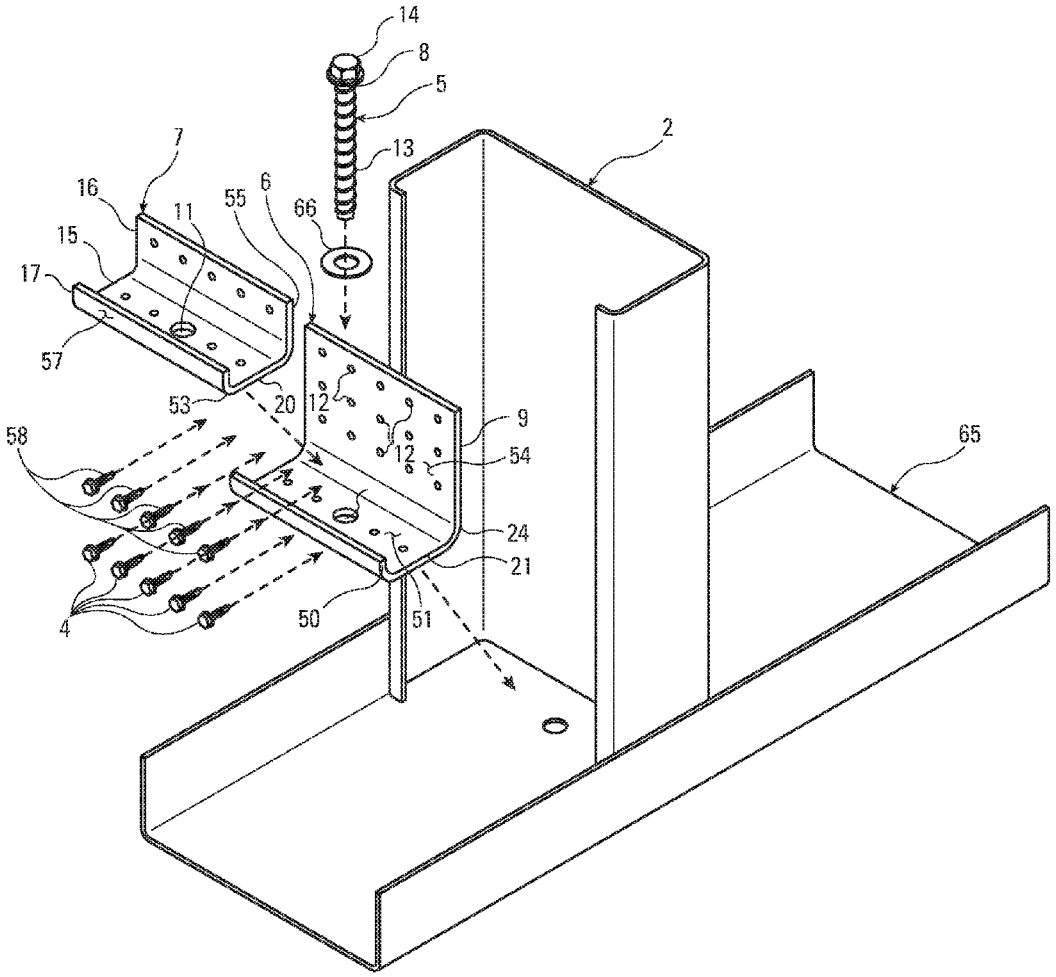
FIG. 2 is an exploded perspective view of a connector constructed in accordance with the present invention.
Figure 3:
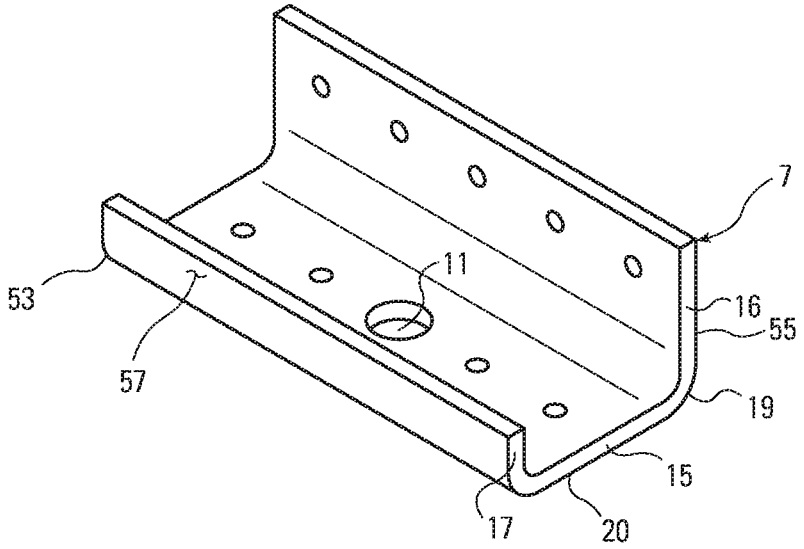
FIG. 3 is a perspective view of the stiffener of the connector of the present invention.

As seen in FIGS. 1 and 2, a connector 1 for tying a first building structural member 2 to a second building structural member 3 in conjunction with fasteners 4 and an anchor member 5, constructed in accordance with the present invention, consists of a connection element 6 which receives the fasteners 4 for attaching the connection element 6 to the first building structural member 2, and a stiffener 7 which nests within the connection element 6 and which receives the first end 8 of the anchor member 5 for attaching the connector 1 to the second building structural member 3.

The anchor member 5 is held by the second building structural member 3 and has a first end 8 protruding above the second building structural member 3.

The preferred connection element 6 of the present invention is formed as an L-shaped member 6 having a base 21 and a back member 9. The base 21 is set at an angle to the back member 9, preferably at an angle substantially close to 90 degrees. The base 21 and the back member 9 are joined at a first juncture 24, preferably this juncture is curved. The base 21 of the connection element 6 is formed with an opening 10 for receiving the anchor member 5 there through for attaching the connector 1 to the second building structural member 3. The back member 9 of the connection element 6 has an inner surface 54.

Figure 5:
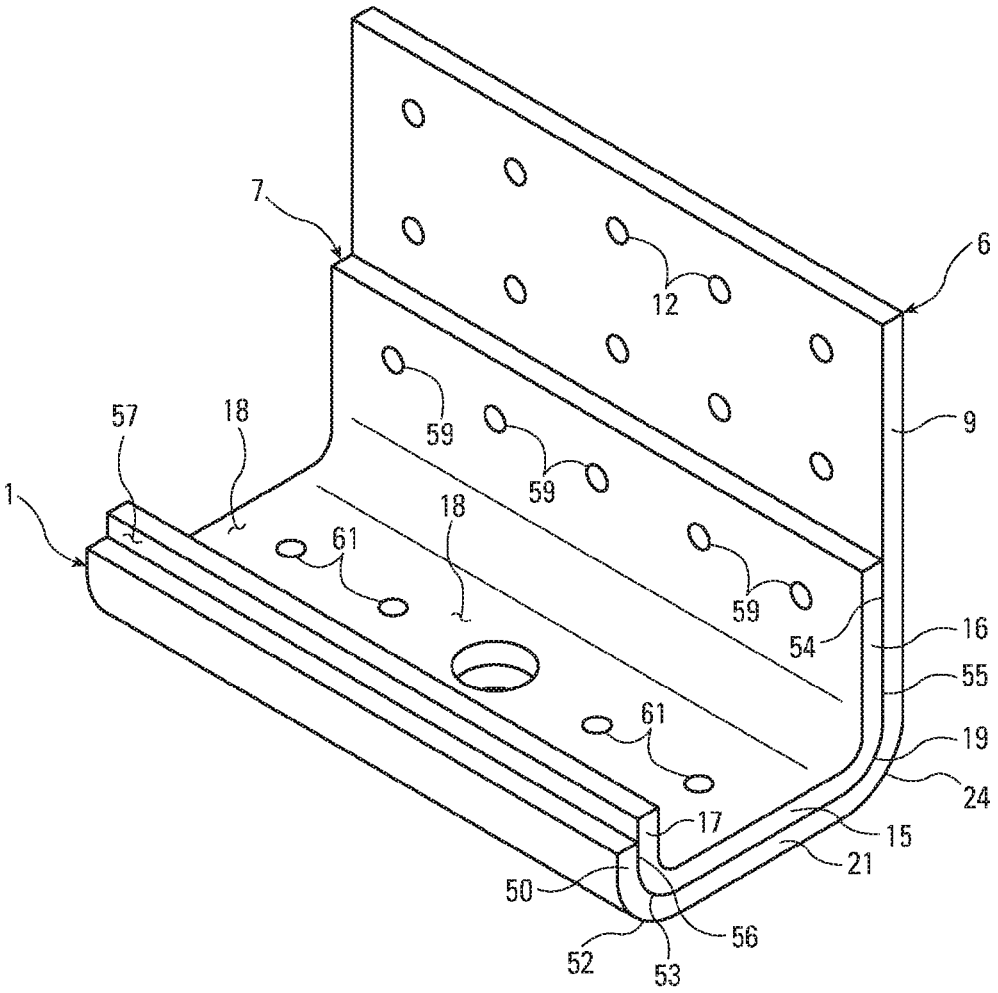
FIG. 5 is a perspective view of the stiffener nested within the connection element of the connector of the present invention.
Figure 6:
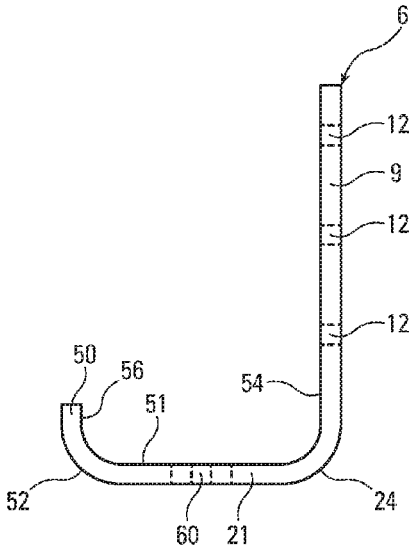
FIG. 6 is a side view of the connection element of the connector of FIG. 1.
Figure 7:
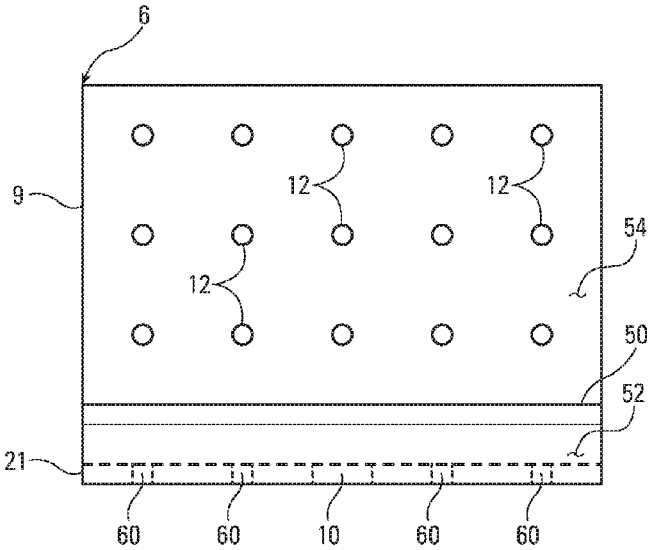
FIG. 7 is a front view of the connection element of the connector of FIG. 1.
Figure 8:
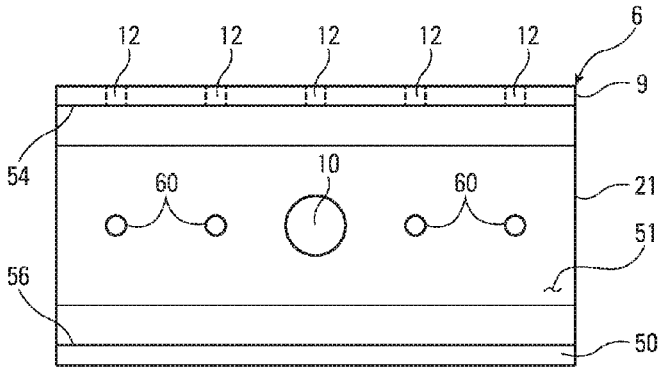
FIG. 8 is a top plan view of the connection element of the connector of FIG. 1.
Figure 9:
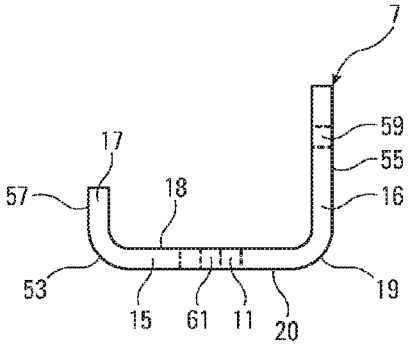
FIG. 9 is a side elevation view of the stiffener of the connector of FIG. 1.
Figure 10:
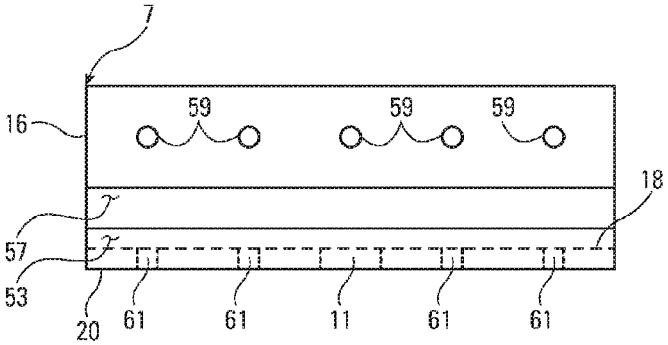
FIG. 10 is a front elevation view of the stiffener of the connector of FIG. 1.
Figure 11:
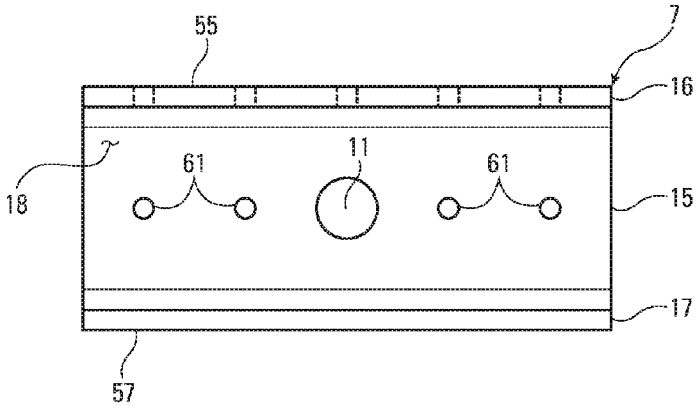
FIG. 11 is a top plan view of the stiffener of the connector of FIG. 1.

The preferred stiffener 7 is a separate member from the L-shaped connection element 6. The preferred stiffener 7 interfaces with the back member 9 of the connection element 6 and bears on the base 21 of the connection element 6. The stiffener 7 is formed with an opening 11 for receiving the anchor member 5. The stiffener 7 is connected to the anchor member 5. The first building structural member 2 which can be a vertically disposed steel stud 2 interfaces with the back member 9. As is shown in FIGS. 5 and 8, the connection element 6 and the stiffener 7 are preferably formed with circular openings 10 and 11 for receiving the anchor member 5. Preferably, the connection element 6 and the stiffener 7 of the connector 1 are formed with openings 12 for receiving the fasteners 4.

Figure 12:
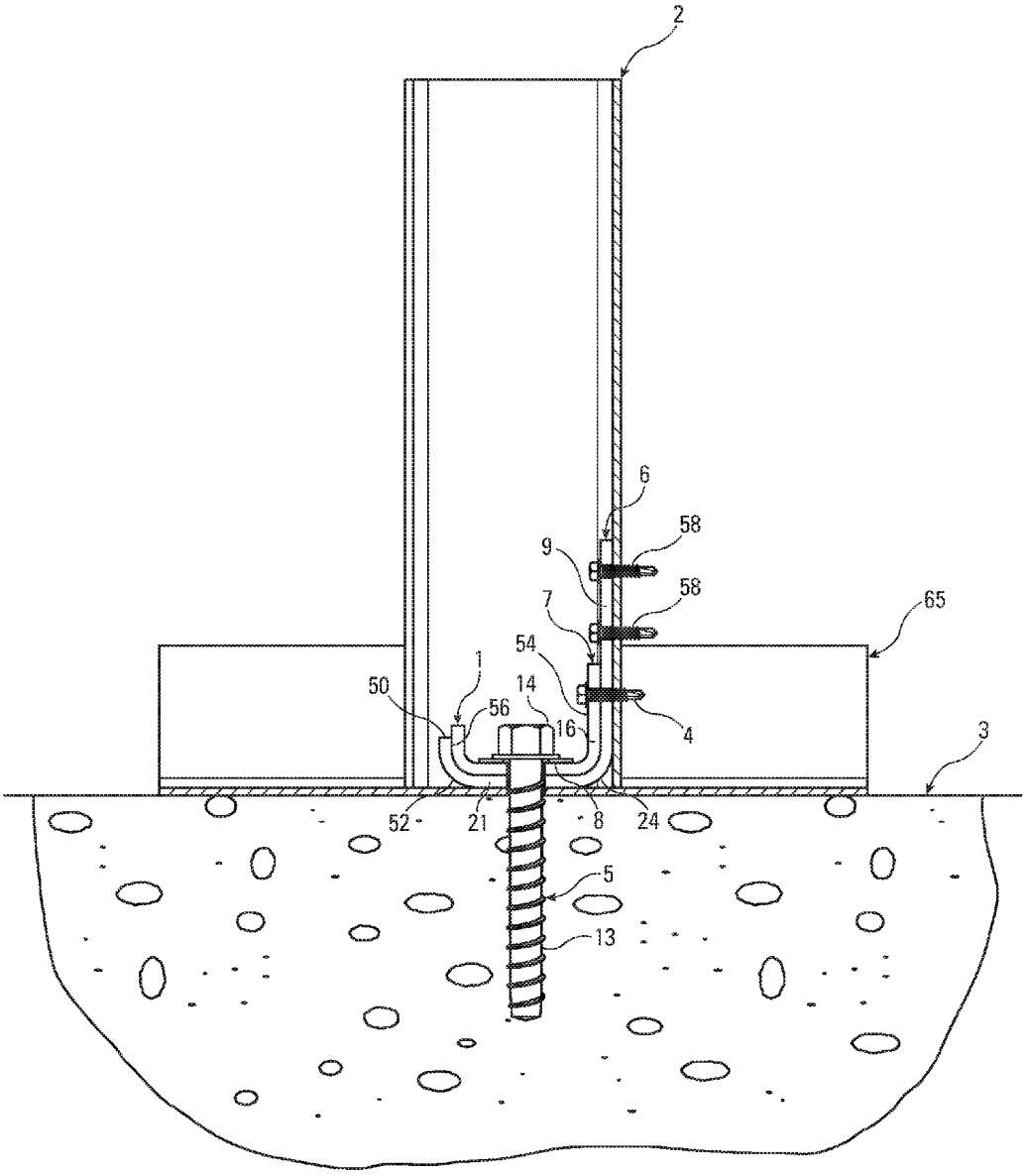
FIG. 12 is a cross-sectional side elevation view of the connection of the present invention, showing the stiffener inserted into the connection element, and the connector connected to the first and second building structural members.

Referring to FIGS. 1, 2 and 12, the anchor member 5 can consist of an anchor bolt with a holding member 14. When the second building structural member 3 is a concrete foundation, the bottom portion 13 of the anchor member 5 is embedded in the second building structural member 3, as shown in FIG. 12. The bottom end 13 of the anchor bolt 5 can be formed with a compound curve to provide pullout resistance, although as shown in FIGS. 2 and 12, the anchor member 5 is a threaded fastener that cuts threads into a bore formed in the concrete foundation 3. The top or first end 8 of the anchor bolt 5 can be formed with a threaded portion to which the holding member 14, generally a threaded nut 14, can releasably attach, completing the anchor member 5, or as shown in FIGS. 1, 2 and 12, the holding member 14 is integrally formed with the anchor member 5 and the holding member 14 is brought into engagement with the stiffener 7.

In the preferred embodiment, the stiffener 7 has a bottom base 15 and first and second lateral side members 16 and 17. The stiffener bottom base 15 has a top surface 18. In the preferred embodiment, the first and second lateral side members 16 and 17 are preferably flanges. In the preferred embodiment, the first lateral side member 16 of the stiffener 7 has an outer surface 55 and a selected height, and the second lateral side member 17 of the stiffener 7 has an outer surface 57 and a selected height. First lateral side member 16 of the stiffener 7 interfaces with the back member 9, and second side member 17 is opposed to the first side member 16. In the preferred embodiment, the first side member 16 of the stiffener 7 interfaces with the back member 9 of the connection element 6 and the bottom base 15 of the stiffener 7 rests on the base 21 of the connection element 6. The bottom base 15 meets the two opposing lateral sides members 16 and 17 at first and second lateral junctures 19 and 53 respectively. The bottom base 15 of the stiffener 7 is also formed with a bearing surface 20. The two opposing lateral side members 16 and 17 each have a selected height that is preferably not the same. In the preferred embodiment, the inner surface 54 of the back member 9 of the connection element 6 is formed to conform substantially to the shape of the outer surface 55 of the first lateral side member 16 of the stiffener 7 for substantially all of the height of the first lateral side member 16. Also in the preferred embodiment, the base 21 and back member 9 of the connection element 6 are formed to substantially conform to the shape of the bearing surface 20 and to the shape of the stiffener 7 at the first lateral juncture 19. The base 21 and opposed flange 50 of the connection element 6 are also formed to substantially conform to the shape of the bearing surface 20 and to the shape of the stiffener 7 at the second lateral juncture 53

In the preferred embodiment, the fasteners 4 are received by both the back member 9 of said connection element 6 and the first lateral side member 16 of said stiffener 7 to connect said connection element 6 and said stiffener 7 to said first building structural member 2.

In the preferred embodiment, the connection element 6 is also formed with an upward projecting, opposed flange 50 that is opposed to the back member 9. The opposed flange 50 of the connection element has an inner surface 56. The conforming top surface 51 of the base 21 and portions of the back member 9 and the lateral flange 50 of the connection element 6 are preferably formed to conform exactly to the shape of the bearing surface 20 and to the shape of the stiffener 7 at the two lateral junctures 19 and 53. Also in the preferred embodiment, the back member 9 and lateral flange 50 of the connection element 6 are formed to conform exactly to the outer surfaces 55 and 57 of the opposing lateral side members 16 and 17 of the stiffener 7 for substantially all of the height of first lateral side member 16 and a portion of the height of second lateral side member 17.

In the preferred embodiment, the lateral junctures 19 and 53 between the bottom bearing surface 20 of the stiffener 7 and the two opposing lateral side members 16 and 17 are formed as continuous curves with relatively large radii.

In the preferred embodiment, the base 21 of the connection element 6 meets the back member 9 at a first curved juncture 24. The radius of this first curved juncture 24 is also a relatively large radius. the base 21 of the connection element 6 meets the opposed flange 50 at a second curved juncture 52. The radius of this second curved juncture 52 is also a relatively large radius. The other dimensions of the connection element 6 are also selected to match the dimensions of the stiffener 7, such that the connection element 6 closely receives the stiffener 7. This eliminates practically all deflection of the connector 1 at the design uplift loads.

Referring to FIG. 2, when the first building structural member 2 is made of cold formed steel, the fasteners 4 are preferably steel screws with cutting points. The fasteners 4 can also be rivets, threaded bolts with nuts, lag screws, or wood screws, if the first building member is made from wood, to name a few variations. The use of self-drilling steel screws as fasteners 4 eliminates the need for the added step of drilling holes in the first building member. As shown in FIG. 1, additional fasteners 58 connect only the back member 9 of the connection element 6 to the first building structural member 2.

As shown in FIG. 1 the back member 9 of the connection element 6 is formed with openings 12 and the stiffener 7 is formed with openings 59 for receiving the fasteners 4 and 64. Additional openings 60 can also be provided in the base 21 of the connection element 6. Additional openings 61 can also be provided in the bottom base of the stiffener 7. These openings 60 and 61 may be used when additional fasteners are needed or when attaching the connector to a different material other than concrete.

When the first building structural member 2 is made of steel the connector 1 can be welded to the first building structural member 2, thus the back member 6 and the stiffener 7 need not be formed with openings 12 and the fasteners 4 can be welds. The welds could connect both the stiffener 7 and the back member 9 to the first building structural member 2.

The connection element 6 of the preferred embodiment is formed from sheet metal. The preferred embodiment of the stiffener 7 is also made from sheet steel.

Figure 4:
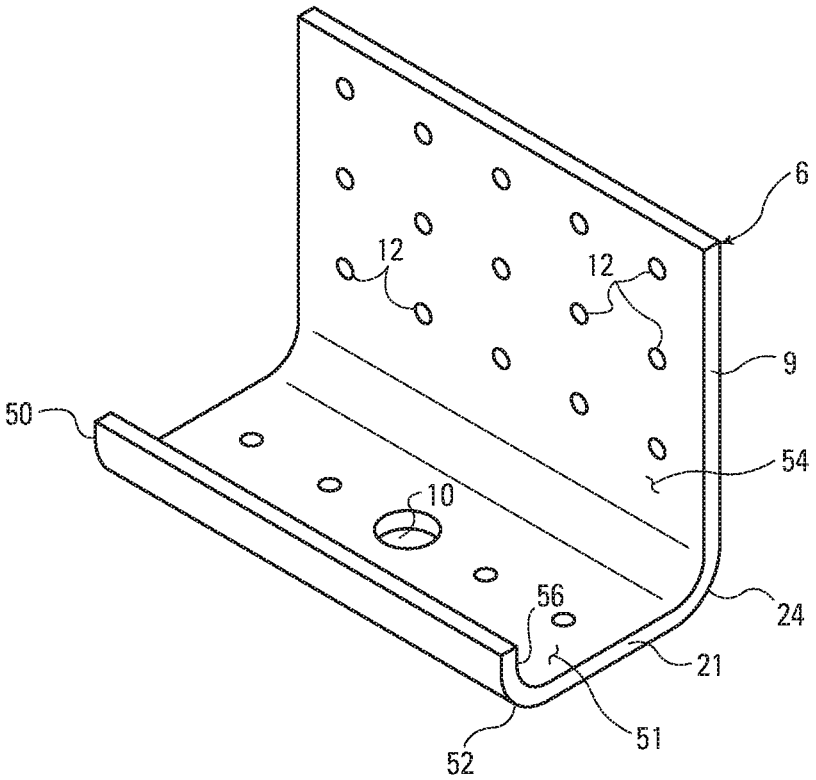
FIG. 4 is a perspective view of the connection element of the connector of the present invention.

The preferred embodiment is formed in the following manner. A blank, which will become the connection element 6, is cut from sheet metal. The openings 10 and 12 in the connection element 6 are formed by cutting out portions from the blank. The blank is then formed into the generally L-shaped member shown in FIG. 4, by bending the back member 9 up from the base 21. The stiffener 7 is formed similarly. The stiffener 7 is then inserted into connection element 6.

As shown best in FIGS. 2 and 12, in the preferred embodiment, the connection element 6 and the stiffener 7 are separate members. In the preferred embodiment, when tension forces are placed on the connector 1 the stiffener 7 resists uplift forces on the connection element 6 by holding the base of the connection element 6 down.

FIG. 12 shows a typical use of the preferred embodiment. In FIG. 12 the first building structural member 2 is a vertical stud 2 of a framed wall and the second building structural member 3 is a concrete foundation 3. The present invention may also be used to transfer tension loads between floors of a framed structure, or to tie joists to masonry or concrete walls, to name but a few applications.

Installation of the connector 1 of the preferred embodiment to form a foundation-to-steel-stud connection is illustrated by FIG. 12. First, an anchor bolt opening is created in the second building structural member 3 and the first structural member is located with respect to the opening in the second building structural member 3. The connector 1 is then placed with the back member 9 of the connection element 6 interfacing with a vertical surface of the first building structural member 2 with the stiffener engaged with the connection element 6. The anchor member 5 is inserted into the openings 10 and 11 in the connection element 6 and the stiffener 7, such that the holding member 14 of the anchor member 15 engages the stiffener 7.

Fasteners 4 are driven into the first building structural member 2 through the openings 12 in the connection element 6 and the openings 59 in the stiffener 7, forming a tight fit between the connection element 6 of the connector 1 and the first building structural member 2, completing the connection. As shown in FIG. 1, a cold formed steel bottom sill 65 is disposed between the connector 1 and the second building structural member 3. The anchor member 5 pierces the bottom sill 65. As shown in FIG. 2, a washer 66 can be used with the anchor member 5. The washer 66 is compressed between the holding member 14 of the anchor member 5 and the top surface 18 of the bottom base 15 of the stiffener 7.

We claim:

1. A connection between a first building structural member and a second building structural member comprising:

a. said second building structural member;

b. one or more anchor members, held by said second building structural member, said one or more anchor members, each having a first end protruding above said second building structural member;

c. a connector receiving said first ends of said one or more anchor members, said connector comprising:

1. a connection element having a base and a back member joined at a juncture, said base lying at an angle with respect to said back member, said base of said connection element being formed with one or more openings for receiving said one or more anchor members there through for attaching said connector to said second building structural member;

2. a separate stiffener, having a bottom base and a first lateral side member set at an angle thereto, said first lateral side member of said stiffener interfacing with said back member of said connection element and said bottom base of said stiffener resting on said base of said connection element, said stiffener being formed with one or more openings for receiving said anchor member, said stiffener being connected to said one or more anchor members;

d. said first building structural member interfacing with said back member of said connection element;

e. one or more fasteners received by both said back member of said connection element and said first lateral side member of said stiffener to connect said connection element and said stiffener to said first building structural member.

2. The connection of claim 1, wherein:

a. said bottom base of said stiffener meets said first lateral side member at a first lateral juncture, said bottom base of said stiffener being formed with a bearing surface, and said first lateral side member having a selected height; and b. said base and back member of said connection element are formed to substantially conform to the shape of said bearing surface and to the shape of said stiffener at said first lateral juncture.

3. The connection of claim 2, wherein:

a. said back member of said connection element has an inner surface;

b. said first lateral side member of said stiffener has an outer surface; and c. said inner surface of said back member of said connection element is formed to substantially conform to the shape of said outer surface of said first lateral side member of said stiffener for substantially all of said height of said first lateral side member.

4. The connection of claim 3, wherein:

a. said stiffener has a second lateral side member, said bottom base meeting said second lateral side member at a second lateral juncture, and said second lateral side member having a selected height; and b. said connection element is formed with an opposed flange opposed to said back member, and said base and opposed flange of said connection element are formed to substantially conform to the shape of said bearing surface and to the shape of said stiffener at said second lateral juncture.

5. The connection of claim 4, wherein:

a. said opposed flange of said connection element has an inner surface;

b. said second lateral side member of said stiffener has an outer surface; and c. said inner surface of said opposed flange of said connection element is formed to substantially conform to the shape of said outer surface of said second lateral side member of said stiffener for a portion of said height of said second lateral side member.

6. The connection of claim 2, wherein:

a. said stiffener has a second lateral side member, said bottom base meeting said second lateral side member at a second lateral juncture, said second lateral side member having a selected height; and b. said connection element is formed with an opposed flange opposed to said back member, and said base and opposed flange of said connection element are formed to substantially conform to the shape of said bearing surface and to the shape of said stiffener at said second lateral juncture.

7. The connection of claim 6, wherein:

a. said opposed flange of said connection element has an inner surface;

b. said second lateral side member of said stiffener has an outer surface; and c. said inner surface of said opposed flange of said connection element is formed to substantially conform to the shape of said outer surface of said second lateral side member of said stiffener for a portion of said height of said second lateral side member.

8. The connection of claim 2, wherein:

said first lateral juncture, where said bottom surface of said bottom base of said stiffener meets said outer surface of said first lateral side member, is formed with a continuous curving profile.

9. The connection of claim 1, wherein:

a. said stiffener has a second lateral side member and said bottom base of said stiffener meets said second lateral side member at a second lateral juncture, said bottom base of said stiffener being formed with a bearing surface, and said second lateral side member having a selected height; and b. said connection element is formed with an opposed flange opposed to said back member, and said base and opposed flange of said connection element are formed to substantially conform to the shape of said bearing surface and to the shape of said stiffener at said second lateral juncture.

10. The connection of claim 9, wherein:

a. said opposed flange of said connection element has an inner surface;

b. said second lateral side member of said stiffener has an outer surface; and c. said inner surface of said opposed flange of said connection element is formed to substantially conform to the shape of said outer surface of said second lateral side member of said stiffener for a portion of said height of said second lateral side member.

11. The connection of claim 1, wherein:

said back member of said connection element is formed with openings for receiving said fasteners.

12. The connection of claim 1, wherein:

additional fasteners connect only said back member of said connection element to said first building structural member.

13. A connection between a first building structural member and a second building structural member comprising:

a. said second building structural member;

b. one or more anchor members, held by said second building structural member, said one or more anchor members, each having a first end protruding above said second building structural member;

c. a connector receiving said first ends of said one or more anchor members, said connector comprising:

1. a connection element having a base and a back member joined at a juncture, said base lying at an angle with respect to said back member, said base of said connection element being formed with one or more openings for receiving said anchor member there through for attaching said connector to said second building structural member;

2. a separate sheet steel stiffener, having a bottom base and a first lateral side flange set at an angle thereto, the bottom base having a top surface and the top surface of the bottom base being disposed below most of the first lateral side flange, said first lateral side flange of said stiffener interfacing with said back member of said connection element and said bottom base of said stiffener resting on said base of said connection element, said stiffener being formed with one or more openings for receiving said one or more anchor members, said stiffener being connected to said one or more anchor members;

d. said first building structural member interfacing with said back member of said connection element; wherein e. said bottom base of said stiffener meets said first lateral side flange at a first lateral juncture, said bottom base of said stiffener being formed with a bearing surface, and said first lateral side flange having a selected height; and f. said base and back member of said connection element are formed to substantially conform to the shape of said bearing surface and to the shape of said stiffener at said first lateral juncture.

14. The connection of claim 13, wherein:

a. said back member of said connection element has an inner surface;

b. said first lateral side flange of said stiffener has an outer surface; and c. said inner surface of said back member of said connection element is formed to substantially conform to the shape of said outer surface of said first lateral side flange of said stiffener for substantially all of said height of said first lateral side flange.

15. The connection of claim 14, wherein:

a. said stiffener has a second lateral side flange, said bottom base meeting said second side flange at a second lateral juncture, said second lateral side flange having a selected height; and b. said connection element is formed with an opposed flange opposed to said back member, and said base and opposed flange of said connection element are formed to substantially conform to the shape of said bearing surface and to the shape of said stiffener at said second lateral juncture.

16. The connection of claim 15, wherein:

a. said opposed flange of said connection element has an inner surface;

b. said second lateral side flange of said stiffener has an outer surface; and c. said inner surface of said opposed flange of said connection element is formed to substantially conform to the shape of said outer surface of said second lateral side flange of said stiffener for a portion of said height of said second lateral side flange.

17. The connection of claim 13, wherein:

a. said stiffener has a second lateral side flange, said bottom base meeting said second lateral side flange at a second lateral juncture, said second lateral side flange having a selected height; and b. said connection element is formed with an opposed flange opposed to said back member, and said base and opposed flange of said connection element are formed to substantially conform to the shape of said bearing surface and to the shape of said stiffener at said second lateral juncture.

18. The connection of claim 17, wherein:

a. said opposed flange of said connection element has an inner surface;

b. said second lateral side flange of said stiffener has an outer surface; and c. said inner surface of said opposed flange of said connection element is formed to substantially conform to the shape of said outer surface of said second lateral side flange of said stiffener for a portion of said height of said second lateral side flange.

19. The connection of claim 13, wherein:

additional fasteners connect only said back member of said connection element to said first building structural member.

* * * * *